US005579016A

United States Patent [19]

Wolcott et al.

[11] Patent Number: 5,579,016

[45] Date of Patent: Nov. 26, 1996

[54] PHASED ARRAY MULTIPLE AREA NULLING ANTENNA ARCHITECTURE

[75] Inventors: James L. Wolcott, La Mirada; William C. Wong, Palos Verdes Estates; Kenneth E. Westall, Seal Beach, all of Calif.

[73] Assignee: TRW Inc., Redondo Beach, Calif.

[21] Appl. No.: 531,262

[22] Filed: Sep. 20, 1995

[51] Int. Cl.[6] ..... H01Q 3/22; H01Q 3/24; H01Q 3/26

[52] U.S. Cl. ..... 342/378; 342/383; 342/384

[58] Field of Search ..... 342/378, 383, 342/384

[56] References Cited

U.S. PATENT DOCUMENTS 4,338,605 7/1982 Mims .
4,651,155 3/1987 Baurle et al. .
4,931,977 6/1990 Klemes .
5,175,558 12/1992 Dupree ..... 342/378
5,371,506 12/1994 Yu et al. ..... 342/380

*Primary Examiner*—Theodore M. Blum
*Attorney, Agent, or Firm*—Michael S. Yatsko

[57] ABSTRACT

An adaptive nulling communication system for nulling undesired signals from communication signals in multiple separate and distinct coverage areas is disclosed. The adaptive nulling communication system includes a phased array antenna having multiple receiving elements to form a single aperture for receiving multiple signals. A first set of beam forming networks coupled to the phased array antenna forms the multiple separate and distinct coverage areas. A distribution network coupled to the first set of beam forming networks distributes the signals received from these coverage areas. A nulling processor having a second beam forming network coupled to the distribution network weights and adjusts the second beam forming network in response to the undesired signals to null these undesired signals from the communication signals.

21 Claims, 5 Drawing Sheets

PHASED ARRAY MULTIPLE AREA NULLING ANTENNA ARCHITECTURE

This invention herein described has been made in the course of or under U.S. Government Contract No. FOA701-93-C-0027 or a subcontract thereunder with the Department of Air Force.

BACKGROUND OF THE INVENTION

1. Field of the Invention

This invention relates generally to a communication system, and more particularly, to a phased array multiple area nulling antenna utilized in an adaptive nulling communication system for providing independent simultaneous nulling in two or more separate and distinct coverage areas seen by a single nulling antenna.

2. Discussion of the Related Art

Various types of adaptive antenna control systems have been developed to counteract jamming systems or unintentional interference. In general, adaptive antenna control systems reduce the relative strength of a jamming or unintentional interference signal by sensing its direction of origin and greatly reducing the response of the antenna in that direction, while maintaining relatively high gain in the directions of desired emitters. When the desired emitters can be grouped based on signal characteristics within separate and distinct coverage areas or theaters of interest, a common design strategy for maximizing the received strength of the desired signals is to shape the antenna patterns to match the coverage areas. However, in a stressed environment, the need exists to provide independent simultaneous nulling in each of these coverage areas.

In prior art high performance adaptive nulling systems, a nulling process is used to process, at high speed, a relatively small number of signals from a multi-beam antenna. U.S. Pat. No. 5,175,558 describes one such process having an associated multi-beam antenna subsystem which has been implemented for military communication satellites. In the prior art, a physically separate mechanically steerable multi-beam antenna and nulling subsystem is used for each coverage area or theater of interest which has its own distinct signal characteristic. This results in an additional increment of antenna weight, power and cost for each theater to be serviced. In addition, since each theater generally will have a different size or shape, each multi-beam antenna aperture must be custom designed, in advance, for the expected dimensions of each particular theater. This results in higher costs and non-uniformity for each system; it also results in sub-optimum performance if the actual theater shape differs significantly from that anticipated in the design. Still further, by custom designing each antenna, less interchangeability is exhibited, which can result in shorter useful life of the system when failures occur. Thus, the prior art adaptive nulling systems based on multi-beam antennas may not operate as economically, flexibly or reliably as desired.

Active phased array antennas, in contrast to fixed pattern multi-beam antennas, could offer greater flexibility in this application. Phased array antennas can be reconfigured electrically at any time to respond to changes in the shape of an area to be covered, and they are readily expandable to provide simultaneous coverage of multiple areas using a single aperture. Furthermore, in applications like satellite platforms where the total surface area available for mounting antennas is at a premium, sharper resolution and better control of the antenna patterns can be achieved in every theater by "re-using" one large aperture, than by proliferating small apertures in the same available mounting area, and dedicating each of these small apertures to a single theater. However, the need to process signals from a relatively large number of phased array elements, and to change the gain and phase of each of them very rapidly in real time, presents a formidable challenge to the processing element which implements the nulling process. For a given processing element capability, the designer is forced to trade hulling reaction time for the pattern-control benefits of larger numbers of elements. In the prior art, practical limitations on the computational speed and throughput of this processing element have placed high performance nulling processes such as that described in U.S. Pat. No. 5,175,558 out of reach for even moderately-sized phased array antenna systems, in weight and power limited applications such as satellite communications.

What is needed then is a phased array based multiple area hulling antenna architecture for use with an adaptive nulling communication system, which can provide independent simultaneous hulling in two or more separate and distinct theaters with a single antenna, and exhibit a level of performance which is commensurate with that of the prior art based on multi-beam antennas. This will afford all the interference-reducing benefits of the high performance processes, while eliminating the need for multiple antenna apertures to cover multiple theaters, reducing weight, power and cost required for covering additional theaters, allowing real-time adjustment of coverage areas, and providing a high level of redundancy which is advantageous for providing more reliability in the system. It is, therefore, an object of the present invention to provide such a phased array multiple area nulling antenna for use with an adaptive hulling communication system.

SUMMARY OF THE INVENTION

In accordance with the teachings of the present invention, an adaptive nulling communication system for nulling undesired signals from communication signals in multiple separate and distinct coverage areas is disclosed. This is achieved by requiring that users in each coverage area share common signal characteristics which distinguish them from users in the other coverage areas, and by utilizing a system architecture with two tiers of active beam forming networks. The first tier of beam forming networks is coupled to a single phased array antenna to form coverage patterns which cover multiple separate and distinct coverage areas with relatively slowly-changing spatial properties. The second tier of beam forming networks is adjusted dynamically in response to fast-acting jamming or unintentional interference.

In one preferred embodiment, the phased array antenna includes multiple receiving elements used to form a single aperture for receiving multiple signals. A first set of beam forming networks is coupled to the phased array antenna to provide signal coverage in multiple separate and distinct coverage areas. A distribution network coupled to the first set of beam forming networks distributes the signals received from these multiple separate and distinct coverage areas. A nulling processor having a second beam forming network coupled to the distribution network weights and adjusts the second beam forming network in response to undesired signals to null the undesired signals from communication signals.

Use of the present invention provides an adaptive nulling communication system for nulling undesired signals from communication signals in multiple separate and distinct coverage areas. As a result, the aforementioned disadvantages associated with current adaptive nulling techniques have been substantially eliminated.

BRIEF DESCRIPTION OF THE DRAWINGS

Still other advantages of the present invention will become apparent to those skilled in the art after reading the following specification and by reference to the drawings in which.

DETAILED DESCRIPTION OF THE PREFERRED EMBODIMENT(S)

The following description of the preferred embodiments concerning a phased array multiple area nulling antenna architecture for an adaptive nulling communication system is merely exemplary in nature and is in no way intended to limit the invention or its application or uses. Moreover, while the present invention is described in detail below with reference to a satellite based communications system, it will be appreciated by those skilled in the art that the present invention is not strictly limited to communication systems for satellites, but may also be implemented in any airborne, spaceborne, terrestrial or underwater communications application. Still further, the present invention is not limited to only adaptive nulling of jamming signals, but may include adaptive nulling of unintentional interference signals.

Figure 1:
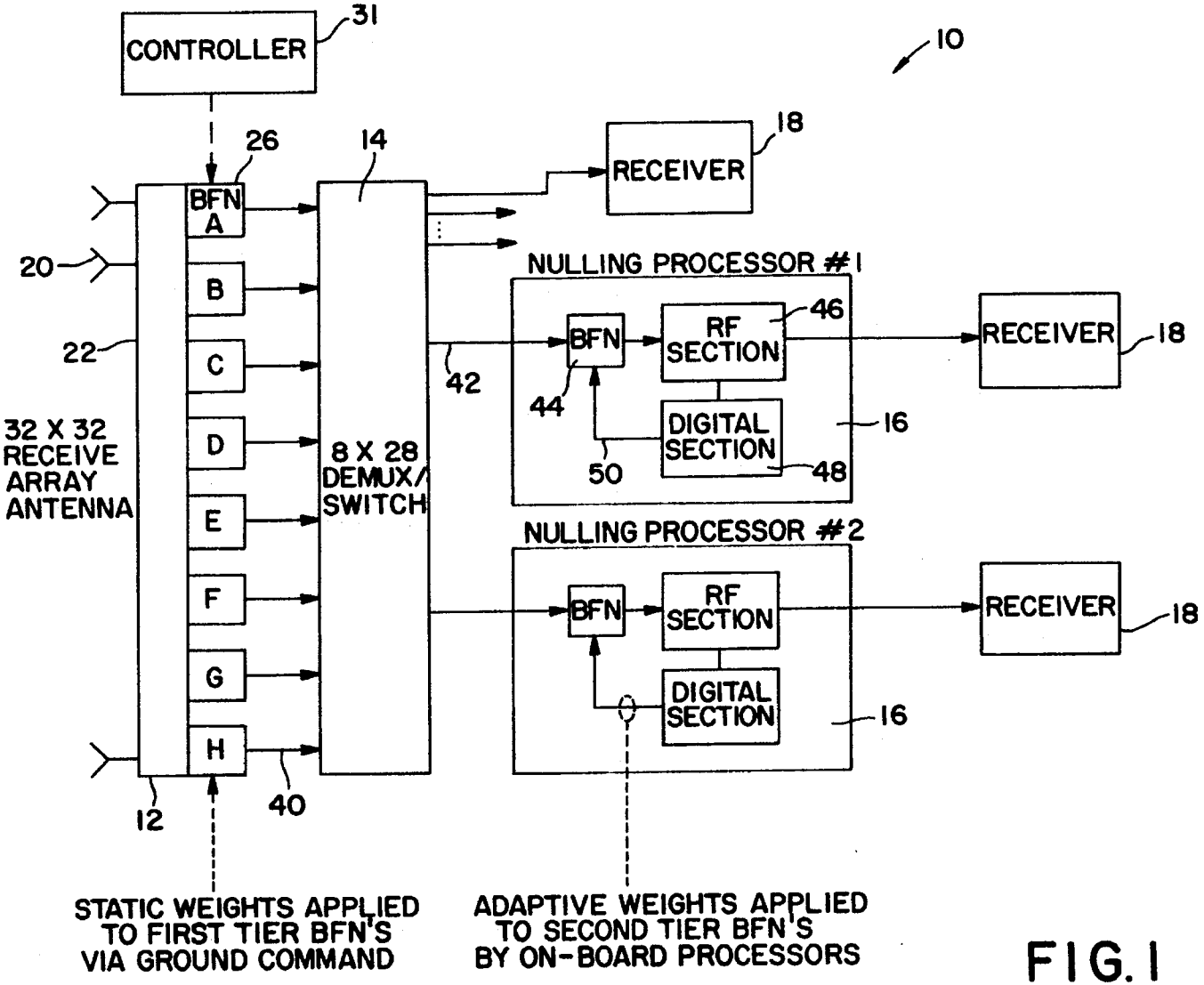
FIG. 1 is a schematic block diagram of an adaptive hulling communication system utilizing a phased array multiple area nulling antenna of the present invention.

Referring to FIG. 1, a schematic block diagram of an adaptive nulling communication system 10 for adaptively nulling jamming or unintentional interference signals is shown. The adaptive nulling communication system 10 includes a phased array multiple area nulling antenna 12 for receiving communication signals and undesired signals in various bands such as X-band. The RF signals received by the phased array multiple area nulling antenna 12 are distributed by a distribution network 14. The distribution network 14 distributes the RF signals received by the phased array multiple area nulling antenna 12 to multiple nulling processors 16 or directly to receivers 18.

Figure 2:
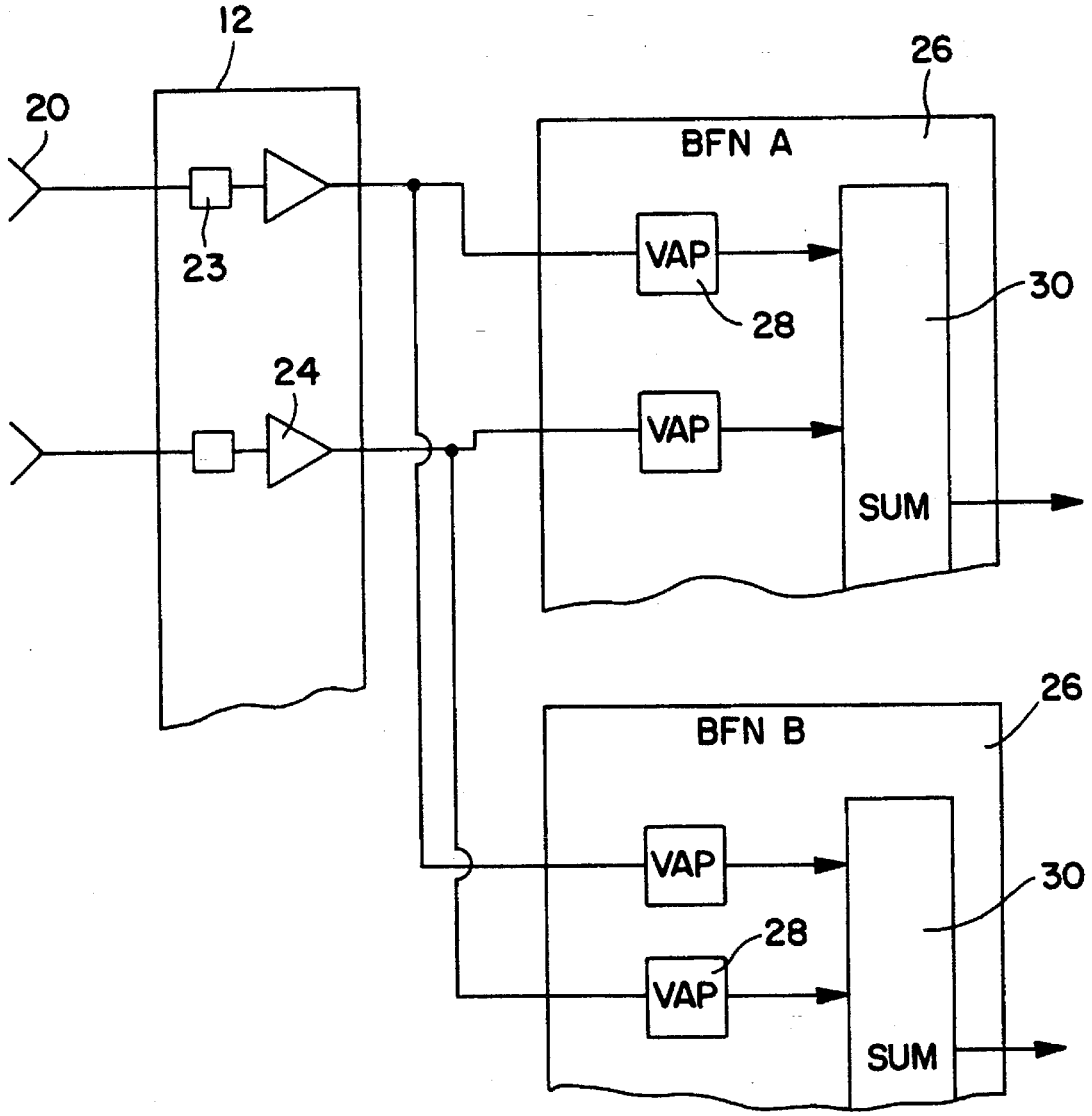
FIG. 2 is an enlarged schematic block diagram of the phased array multiple area nulling antenna of the present invention.

The phased array multiple area nulling antenna 12, shown clearly in FIG. 2, includes multiple receiving elements 20 used to form a single aperture 22 of the antenna 12. For illustrative purposes, there are 32×32 receiving elements 20, for a total of 256 receiving elements 20 positioned to form a square aperture 22. The receiving elements 20 can be comprised of dipoles, crossed dipoles, patches, helices, horns or any other type of receiving element 20 that can couple electromagnetic energy from a radiating field. The receiving elements 20 may have a spacing such as a lattice or hexagonal spacing to form a square, rectangular, round, elliptical or other shaped aperture 22. The specific spacing of the receiving elements 20 and the shape of the aperture 22 may depend on the size and shape of the coverage areas or theaters of interest, but is preferably constructed having a uniform spacing and a standard shape to cover numerous coverage areas.

The RF signals received by the receiving elements 20 are band pass filtered by band pass filters 23 and amplified by amplifiers 24. The filtered and amplified RF signals are then distributed to multiple beam forming networks (BFN) 26 (i.e. BFNs A–H). In other words, each receiving element 20 has a separate band pass filter 23 and an amplifier 24 which filters and amplifies the received RF signal and distributes the filtered and amplified RF signals to each beam forming network 26 simultaneously. One skilled in the art would also recognize that the specific type of receiving element 20 can also be selected to operate only in the frequency band of interest, in which case the band pass filter 23 could be eliminated.

Each beam forming network 26 includes multiple variable amplitude and phase (VAP) elements 28 and a summer 30, as shown in FIG. 2. The number of variable amplitude and phase elements 28 corresponds to the number of receiving elements 20. Each variable amplitude and phase element 28 is open loop or statically weighted to adjust the amplitude and phase of the received RF signals which are then subsequently combined and summed in the summer 30.

The amplitude and phase adjustment by the variable amplitude and phase elements 28 allows each beam forming network 26 the capability to simultaneously and independently form multiple high-gain antenna patterns to cover multiple coverage areas or theaters of interest. These multiple coverage patterns may be specifically shaped to cover various regions such as different continents or portions of various oceans. For example, referring to FIGS. 3A–3D, multiple coverage patterns or areas formed by the beam forming networks 26 are shown for illustrative purposes.

Figure 3B:
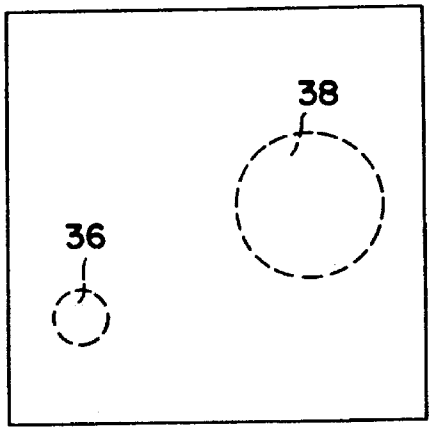
FIGS. 3A–3D are a series of coverage patterns formed by the phased array multiple area nulling antenna of the present invention.
Figure 3D:
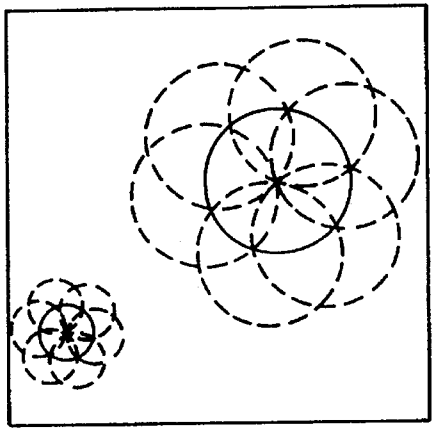
Figure 3A:
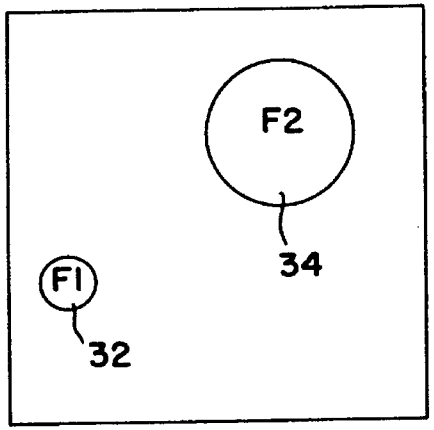

In FIG. 3A, coverage areas 32 and 34 are shown which are shaped by the single BFN A using known antenna beam forming techniques. Users in coverage area 32 are assigned to a frequency band F1, and those in coverage area 34 are assigned to a different frequency band F2. Separate and distinct frequency bands F1 and F2 are assigned to users in separate and distinct theaters 32 and 34 to prevent possible system self-interference. Since each output of the first tier of beam forming networks 26 contains signals from multiple coverage areas, legitimate users of the system located in one theater or coverage area could present interference to the nulling processors 16 assigned to other theaters, diluting their power to suppress real jammers or unintentional interferers within their assigned theaters. This potential self-interference is avoided by providing filters in the nulling processor 16 which discriminate against system users which are located outside the theater assigned to that nulling processor 16. One skilled in the art would also recognize that shared signal features or characteristics other than frequency band (such as pseudo-random codes and time slot assignments) could be used to distinguish users in one coverage area from those in other areas. For example, users in coverage area 32 may share one subset of spectrum spreading codes in a code division multiple access (CDMA) system, to provide signal discrimination against users in coverage area 34, which share a separate set of codes.

While only two separate and distinct coverage areas 32 and 34 are shown in FIG. 3A, one skilled in the art would recognize that many more separate and distinct coverage patterns or areas could also be formed by the single BFN A. The number and quality of coverage areas are dependent on the number of receiving elements 20 used to form the aperture 22 of the phased array multiple area nulling antenna 12 (i.e. degrees of freedom).

Figure 3C:
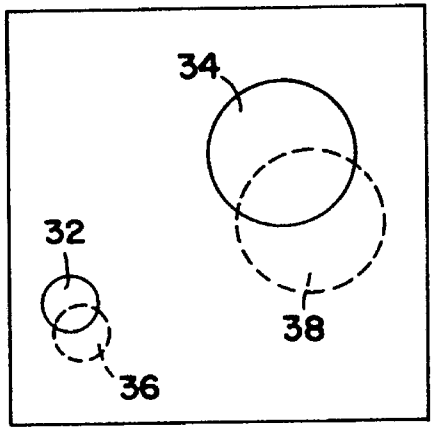

Turning to FIGS. 3B–3C, coverage areas 36 and 38 formed by BFN B are shown. The coverage areas 36 and 38 are the same shape and have the same frequency band of interest as coverage areas 32 and 34, but are slightly offset from coverage areas 32 and 34, as shown in FIG. 3C. In FIG. 3D, additional coverage areas formed by BFNs C–G are shown. As shown in FIG. 3D, BFN A forms the main or primary coverage areas 32 and 34 and BFNs B–G form two (2) pairs of six (6) offset coverage areas which are used for nulling the jamming or unintentional interference signals by weighting and combining the signals received in these coverage areas using known nulling techniques. These nulling techniques cause the system to have negligible response in the direction of the undesired signals. One skilled in the art would also recognize that the present invention is strictly not limited to the configuration shown in FIGS. 3A–3D. Moreover, the present invention is shown with BFN A covering the primary coverage areas 32 and 34, BFNs B–G providing offset coverage areas for nulling purposes and BFN H used as a backup in case any BFN A–G fails.

The first tier or set of beam forming networks 26 (i.e. BFNs A–H) are open loop or statically weighted and adjusted by a controller 31 to provide coverage patterns for the theaters of interest. For example, in a satellite communication system, the beam forming networks 26 are first adjusted apriori to provide signal coverage for the separate coverage areas of interest using a ground based controller 31. In other words, the open loop or static weighting and adjustment of the beam forming networks 26 is based only on forming the particular coverage areas and is not based dynamically on the jamming signals being received. Therefore, if the satellite is in a perfect geosynchronous orbit, the first tier of beam forming networks 26 will only need to be adjusted once to form the required coverage areas. However, since satellites generally do not remain in perfect geosynchronous orbit, and since satellite attitude errors can result in mis-pointing of the antennas, slight adjustments are required in the beam forming networks 26 over time to maintain the desired coverage areas.

In addition, if agile beam coverage is desired, the controller 31 can adjust the beam forming networks 26 over time to cover various sets of coverage areas. For example, BFNs A–G can be weighted and adjusted to form the coverage areas shown in FIGS. 3A–3D for a specific time frame. The BFNs A–G can then be weighted and adjusted to cover a different set of coverage areas for another specific time frame. By doing this, multiple sets of multiple coverage areas can be served by the single phased array multiple area nulling antenna 12. If one set of coverage areas is more critical than another set, those particular coverage areas can be monitored for a longer time frame. In this way, the controller 31 will open loop and dynamically cycle the beam forming networks 26 through various sets of multiple coverage areas, thereby providing even more coverage capabilities.

Returning to FIG. 1, the weighted and summed RF signals from the beam forming networks 26 representing the RF signals received in the various coverage areas, are applied to the distribution network 14. The distribution network 14 distributes the RF signals to the nulling processors 16 and directly to receivers 18. The distribution network 14 may also include amplification (not shown) for maintaining the gain of the RF signals during distribution of the RF signals. For illustrative purposes, the distribution network 14 comprises an 8×32 demux/switch 14 having eight (8) inputs 40 and thirty-two (32) outputs 42. Each input 40 receives the RF signal from one of the first tier beam forming networks 26 (i.e. BFNs A–H). Twelve (12) outputs 42 distribute only the RF signals received from the primary coverage areas 32 and 34, via BFN A, to twelve (12) receivers 18 without performing adaptive nulling. Two (2) sets of eight (8) outputs 42 distribute the RF signals received from each BFN A–H to two separate nulling processors 16 (i.e. nulling processor #1 and nulling processor #2).

The receivers 18 receiving the RF signals directly from BFN A are operated without the benefit of adaptive nulling and may therefore be susceptible to jamming or unintentional interference signals. The receivers 18 following the nulling processors 16 receive the RF signals from either the coverage area 32 or 34 substantially free from jamming or unintentional interference signals. The number of separate nulling processors 16 thus compares to the number of separate and distinct primary coverage areas. If additional coverage areas are desired, additional nulling processors 16 are simply added to the distribution network 14. This addition of nulling processors 16 occurs without the need for additional antenna apertures 22.

The nulling processors 16 preferably consist of the nulling processor set forth in detail in U.S. Pat. No. 5,175,558, which is hereby incorporated by reference. Each nulling processor 16 includes a closed loop or dynamically adjusted beam forming network 44, an RF section 46, and a digital section 48 having a feedback loop 50. The beam forming network 44 in each nulling processor 16 dynamically weights and adjusts the amplitude and phase of the incoming RF signals from each BFN A–H independently based on the received RF signals. Each RF section 46 performs characterizing or filtering to suppress users outside the coverage area of interest, and real time correlation to determine where the jamming signals are being received from (i.e. BFNs A–H). The RF signals in the RF section 46 are then applied to the digital section 48 which digitizes and processes the RF signals. The digital processing determines the next set of weights and adjustments to be applied to the beam forming network 44, via the feedback loop 50, in order to substantially eliminate the jamming or unintentional interference signals.

Figure 4:
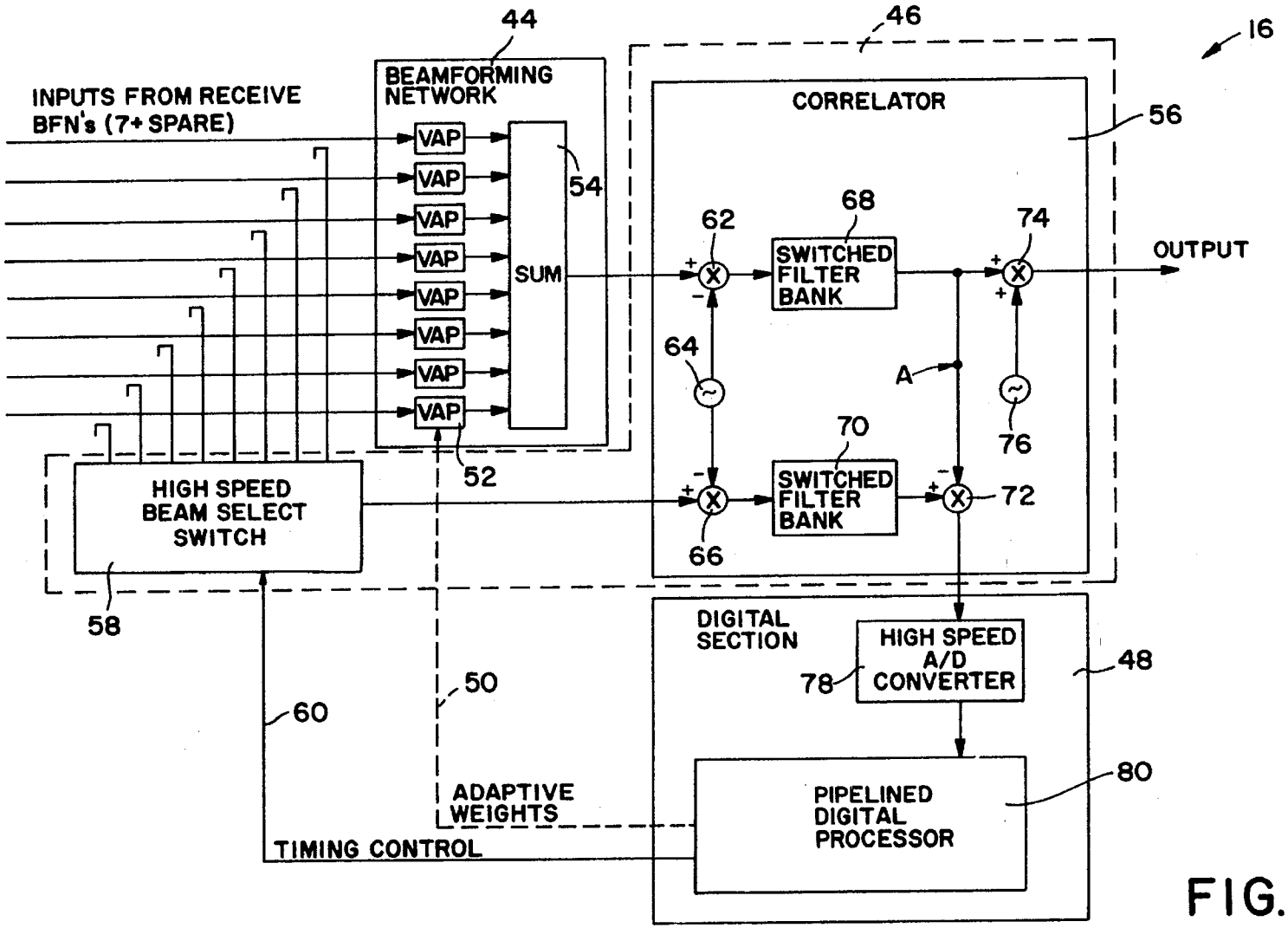
FIG. 4 is a schematic block diagram of one preferred embodiment of a hulling processor used in conjunction with the phased array multiple area nulling antenna of the present invention.

Referring to FIG. 4, a detailed schematic block diagram of one preferred embodiment of the nulling processor 16 is shown. The eight outputs from the beam forming networks 26 (i.e. BFNs A–H), are applied to the beam forming network 44. The beam forming network 44 includes eight (8) variable amplitude and phase (VAP) elements 52 and a summer 54. Each variable amplitude and phase element 52 dynamically weights and adjusts the amplitude and phase of the RF signals in real time and applies the resultant RF signals to the summer 54. The summer 54 combines and sums the weighted RE signals and applies the summed RF signal to a correlator 56 of the RF section 46.

The correlator 56 compares the summed RF signal from the beam forming network 44 to each separate RF signal from each beam forming network 26 (i.e. BFNs A–H) prior to weighting. The correlator 56 performs the RF comparison by sampling each RE signal from each BFN A–H with a high speed beam select switch 58. The high speed beam select switch 58 sequentially switches through each input to the beam forming network 44 based on a timing control signal 60 from the digital section 48.

The summed RF signal is applied to a first mixer 62 in the correlator 56. The first mixer 62 mixes the summed RF signal with a local oscillator signal from a local oscillator 64 which down converts the summed RF signal into a summed intermediate frequency (IF) signal. The sampled RF signals from the high speed beam select switch 58 are applied to a second mixer 66. The second mixer 66 mixes the sampled RF signals with the local oscillator signal from the local oscillator 64 to down convert the sampled RF signals to sampled IF signals. The summed IF signal is applied to a switched filter bank 68 and the sampled IF signals are applied to a switched filter bank 70. Both switched filter banks 68 and 70 are statically switched to the same desired frequency band assigned to the coverage area of interest. By using the same frequency in the local oscillator 64 and the same filter response in switched filter banks 68 and 70, any noise coupled to the RF signals is subsequently cancelled in a correlation mixer 72.

The switched filter bank 68 is shown in FIG. 4 positioned to act as a band pass filter. In other words, the switched filter bank 68, as well as the switched filter bank 70, eliminates, rejects or suppresses all RF signals operating outside the frequency band of interest in the particular coverage area being covered (i.e. F1 or F2). The switched filter bank 68 is positioned as shown when the adaptive nulling communication system 10 is operating to receive RF signals using a code division multiple access (CDMA) signal format.

Alternatively, the switched filter bank 68 may be positioned at point A, in which case switched filter bank 68 operates as a band stop filter. That is, the switched filter banks 68 and 70 eliminate all signals operating inside the frequency band of interest, thereby leaving only the undesired communication signals and jamming signals. This configuration of switched filter banks 68 and 70 is preferably utilized when the adaptive nulling communication system 10 is receiving RF signals using a frequency hopping signal format.

Still further, as opposed to using "switched" filter banks 68 and 70, single filters 68 and 70 can be utilized while the local oscillator 64 is varied in frequency depending on the frequency band of interest. In other words, the local oscillator 64 in each nulling processor 16 would be adjusted to track the desired frequency band of interest (i.e. F1 or F2) and reject the rest, as opposed to adjusting or switching in and out various filters from filter banks 68 and 70. This adjustment of the frequency band can also be varied based upon a pseudo-random code, to track a frequency hopping pattern assigned to users in the coverage area of interest.

The summed IF signal and the sampled IF signals are then applied to the correlator mixer 72 which mixes the IF signals to accomplish a complex multiplication of a sample of the beam forming network 44 sum output signal with the complex conjugate of a sample of the pre-weighted signal present in the single beam forming networks 26 (i.e. BFNs A–H). The resultant IF signal represents the correlation between the summed and sampled IF signals. If the particular IF signal being sampled has a high power level compared to the summed IF signal, that particular sampled IF signal or beam forming network 26 is receiving a jamming or unintentional interference signal. Thus, the variable amplitude and phase elements 52 in the beam forming network 44 are dynamically adjusted in concert, via the feedback loop 50, to cancel out that particular jamming signal. Consequently, the resultant summed IF signal should be substantially free from jamming signals after adaptive hulling has been performed, under control of the digital section 48. This "clean" summed IF signal is then applied to an output mixer 74 which mixes the summed IF signal with a second local oscillator signal from a second local oscillator 76 to up convert the summed IF signal to a summed RF signal. This summed RF signal is subsequently applied to the receiver 18.

The correlation IF signal from mixer 72 is applied to a high speed analog-to-digital converter (A/D) 78 in the digital section 48 which converts the analog signal to a digital signal. This digitized signal representing the correlation IF signal is processed in a pipeline digital processor 80. Since the digital section 48 knows which BFN A–H is being sampled at any particular time, via the timing control signal 60, the digital processor 80 knows which digitized correlation signal corresponds to which BFN A–H. The digital processor 80 operates on the digitized correlation signal to determine the individual adaptive weights to be applied to the variable amplitude and phase elements 52 in the beam forming network 44. This adaptive weighting cancels or nulls the jamming signal received by the particular beam forming network 26.

Figure 5:
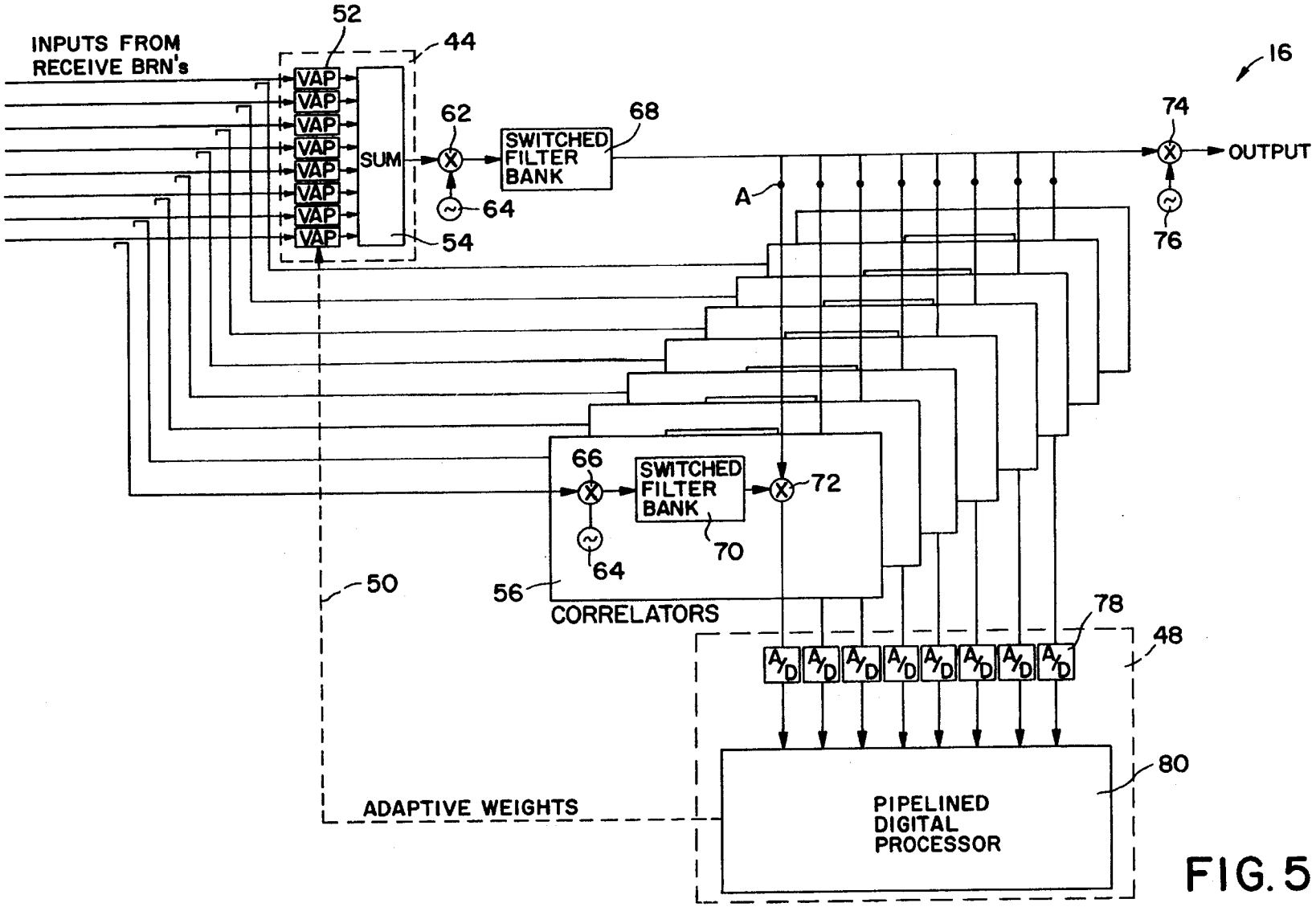
FIG. 5 is a schematic block diagram of another preferred embodiment of the nulling processor used in conjunction with the phased array multiple area nulling antenna of the present invention.

Turning to FIG. 5, another preferred embodiment of the nulling processor 16 is shown. The nulling processor 16 shown in FIG. 5 is substantially identical to the nulling processor 16 shown in FIG. 4, except that the high-speed beam select switch 58 which samples the RF signals from each beam forming network 26 (i.e. BFNs A–H) has been eliminated and a separate RF branch consisting of the mixer 66, the switched filter bank 70 and the correlator mixer 72 has been duplicated, in addition to the analog-to-digital converter 78, for each beam forming network 26 being sampled. By eliminating the high-speed beam select switch 58 and continuously sampling the RF signals from the beam forming networks 26, the performance and response of the nulling processor 16 is increased. However, the cost of this modification includes increased hardware cost, increased power consumption and increased weight.

In operation, the first tier of beam forming networks 26 (i.e. BFNs A–H), are open loop or statically weighted and adjusted apriori to cover the particular coverage areas of interest. The beam forming networks 26 may be slowly adjusted over time if the coverage areas change or if the position of the phased array multiple area nulling antenna 12 changes with respect to the coverage areas. The phased array multiple area nulling antenna 12 then receives the RF signals, via the receiving elements 20, and applies the RF signals to BFNs A–H with the resultant RF signals representing the signals in the particular coverage areas being applied to the distribution network 14. The distribution network 14 distributes the RF signals from the beam forming networks 26 to the second tier of closed loop or dynamically weighted and adjusted beam forming networks 44 in the nulling processors 16, as well as directly to receivers 18. The receivers 18 receiving the RF signals directly from the beam forming network 26 covering the primary coverage area are thus susceptible to jamming or unintentional interference signals.

The RF signals received by the second tier of closed loop or dynamically adjusted beam forming networks 44 are adaptively processed in the nulling processor 16 to remove or null jamming or unintentional inference signals. Upon initial power up of the nulling processor 16, a set of quiescent weights are applied to the variable amplitude and phase elements 52. These quiescent weights are set such that the RF signal received from the beam forming network 26 set to cover the primary coverage area (i.e. BFN A) passes through the beam forming network 44 while the signals from each of the other beam forming networks 26 (i.e. BFNs B–G) used for adaptive nulling contribute no net signal to the output from the coverage area of interest. Upon correlating the summed IF signal with the sampled IF signals, via correlation mixer 72, the digital processor 80 independently adaptively weights and adjusts the variable amplitude and phase elements 52, via the feedback loop 50, to reduce or cancel out (i.e. nulling) the jamming or intentional interference signals. This ultimately results in a substantially clean summed IF signal which is up converted in the mixer 74 to generate a summed RE signal. The summed RF signal is applied to receivers 18 free from jamming or unintentional interference signals.

Use of the present invention eliminates the need for separate adaptive nulling communication systems to cover each separate theater of interest. This ultimately eliminates the need for separate antenna apertures for each theater of interest, allowing reuse of one large aperture in the same mounting area. As a result, performance, flexibility, cost, weight, power consumption and redundancy is improved by use of the present invention over prior art adaptive nulling communication system techniques.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An adaptive nulling communication system for nulling undesired signals from communication signals in multiple separate and distinct coverage areas having at least two separate and distinct primary coverage areas, said system comprising:

phased array antenna means for receiving a plurality of signals, said phased array antenna means including a plurality of receiving elements for receiving said plurality of signals, each of said signals having a signal characteristic;

a plurality of first beam forming networks coupled to said phased array antenna means for providing signal coverage to said multiple separate and distinct coverage areas, each of said first beam forming networks coupled to each of said receiving elements;

distribution means for distributing a plurality of signals received from said multiple separate and distinct coverage areas;

a plurality of second beam forming networks coupled to said distribution means for nulling said undesired signals; and a plurality of processors corresponding to at least the number of separate and distinct primary coverage areas for weighting and adjusting said plurality of second beam forming networks in response to said undesired signals, wherein said plurality of second beam forming networks nulls said undesired signals from said communication signals, each of said processors assigned to a separate and distinct coverage area of interest and each of said processors including characterizing means for identifying communication signals from an assigned coverage area of interest and for suppressing communication signals outside said assigned coverage area of interest based on said signal characteristics of said plurality of signals.

2. The adaptive nulling communication system as defined in claim 1 wherein said phased array antenna means includes a phased array antenna, said phased array antenna includes said plurality of receiving elements forming a single aperture.

3. The adaptive nulling communication system as defined in claim 1 wherein each of said first beam forming networks forms multiple separate and distinct coverage areas.

4. The adaptive nulling communication system as defined in claim 3 further comprising a controller for weighting and adjusting each of said first beam forming networks to form said multiple separate and distinct coverage areas.

5. The adaptive nulling communication system as defined in claim 4 wherein said controller weights and adjusts each of said first beam forming networks over time to cover different sets of multiple separate and distinct coverage areas for specific time frames to provide agile beam coverage.

6. The adaptive nulling communication system as defined in claim 1 wherein each of said characterizing means includes filtering means for filtering said communication signals from said assigned coverage area and for rejecting said communication signals from outside said assigned coverage area.

7. The adaptive nulling communication system as defined in claim 1 wherein each of said characterizing means includes variable oscillator means for tracking said communication signals from said assigned coverage area and for rejecting said communication signals from outside said assigned coverage area.

8. An adaptive nulling communication system for nulling undesired signals from communication signals in multiple separate and distinct coverage areas having at least two separate and distinct primary coverage areas, said system comprising:

phased array antenna having a plurality of receiving elements forming a single aperture for receiving a plurality of signals, each of said signals having a signal characteristic;

a plurality of first beam forming networks coupled to said phased array antenna, each of said first beam forming networks coupled to each of said receiving elements wherein each of said first beam forming networks forms multiple separate and distinct coverage areas;

distribution network coupled to said plurality of first beam forming networks to distribute a plurality of signals received from said multiple separate and distinct coverage areas; and a plurality of nulling processors corresponding to at least the number of separate and distinct primary coverage areas, each of said nulling processors having a second beam forming network coupled to said distribution network, each of said nulling processors weights and adjusts a second beam forming network in response to said undesired signals to null said undesired signals from said communication signals, wherein each of said nulling processors includes characterizing means for suppressing users outside a coverage area of interest based on said signal characteristics of said plurality of signals.

9. The adaptive nulling communication system as defined in claim 8 wherein said receiving elements are selected from a group consisting of dipoles, crossed dipoles, helices, patches and horns.

10. The adaptive nulling communication system as defined in claim 8 wherein each of said first beaming forming networks simultaneously receives said plurality of signals from said receiving elements.

11. The adaptive nulling communication system as defined in claim 10 wherein each of said first beam forming networks includes a plurality of first variable amplitude and phase elements corresponding to the number of receiving elements and a first summer, wherein each of said first variable amplitude and phase elements weights and adjusts the amplitude and phase of signals received by each receiving element to generate resultant signals and said first summer sums said resultant signals in said first summer to generate said signals received from said multiple separate and distinct coverage areas.

12. The adaptive nulling communication system as defined in claim 8 further comprising a controller for weighting and adjusting each of said first beam forming networks to form said multiple separate and distinct coverage areas.

13. The adaptive nulling communication system as defined in claim 12 wherein said controller weights and adjusts each of said first beam forming networks over time to cover different sets of multiple separate and distinct coverage areas for specific time frames to provide agile beam coverage.

14. The adaptive nulling communication system as defined in claim 8 wherein each of said receiving elements is coupled to each of said first beam forming networks and each of said first beam forming networks is coupled to each of said second beam forming networks.

15. The adaptive nulling communication system as defined in claim 8 wherein each of said second beam forming networks includes a plurality of second variable amplitude and phase elements corresponding to the number of first beam forming networks and a second summer, wherein each of said second variable amplitude and phase elements weights and adjusts the amplitude and phase of said signals received from said multiple separate and distinct coverage areas to generate resultant signals and said second summer sums the resultant signals to generate a summed signal.

16. The adaptive nulling communication system as defined in claim 8 wherein each of said nulling processors includes a correlator for comparing a summed signal from a second beam forming network to each signal from each first beam forming network to determine which multiple separate and distinct coverage areas said undesired signals are transmitting from.

17. The adaptive nulling communication system as defined in claim 16 wherein each of said nulling processors further includes a high speed beam select switch for sampling each of said signals from each of said first beam forming networks.

18. The adaptive nulling communication system as defined in claim 16 wherein each of said correlators simultaneously compares a summed signal from a second beam forming network with each of said signals from each of said first beam forming networks.

19. A method for adaptively nulling undesired signals from communication signals in multiple separate and distinct coverage areas having at least two separate and distinct primary coverage areas, said method comprising the steps of:

receiving a plurality of signals from a phased array antenna having a plurality of receiving elements forming a single aperture;

coupling each of said receiving elements to each of a plurality of first beam forming networks;

forming multiple separate and distinct primary coverage areas and offset coverage areas from said plurality of first beam forming networks;

distributing a plurality of signals received in said primary coverage areas and said offset coverage areas to a plurality of second beam forming networks;

weighting and adjusting said plurality of second beam forming networks in response to said undesired signals with a plurality of nulling processors corresponding to the number of separate and distinct primary coverage areas to null said undesired signals from said communication signals;

assigning a separate and distinct primary coverage area of interest to each of said nulling processors; and characterizing said communication signals in each of said nulling processors based on signal characteristics to suppress communication signals outside said assigned coverage area of interest of each of said nulling processors.

20. The method as defined in claim 19 wherein the step of forming multiple separate and distinct primary coverage areas and offset coverage areas from said plurality of first beam forming networks further includes the step of weighting and adjusting a plurality of variable amplitude and phase elements in each of said first beam forming networks.

21. The method as defined in claim 19 wherein the step of weighting and adjusting said plurality of second beam forming networks further includes the step of weighting and adjusting a plurality of second variable amplitude and phase elements in each second beam forming network.

* * * * *